US006983693B2

(12) United States Patent
Simons

(10) Patent No.: US 6,983,693 B2
(45) Date of Patent: Jan. 10, 2006

(54) METHOD AND SUBSTRATE FOR THE PREPARATION OF A PRINTING PLATE

(75) Inventor: Michael J. Simons, Middlesex (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/628,192

(22) Filed: Jul. 28, 2003

(65) Prior Publication Data

US 2004/0020388 A1 Feb. 5, 2004

(30) Foreign Application Priority Data

Aug. 2, 2002 (GB) ..... 0217979

(51) Int. Cl.
*B41N 1/00* (2006.01)

(52) U.S. Cl. ..... 101/457; 101/462; 101/466

(58) Field of Classification Search ..... 101/457, 101/462, 465, 466; 347/96
See application file for complete search history.

(56) References Cited

U.S. PATENT DOCUMENTS 4,097,645 A * 6/1978 Toyoda et al. ..... 428/315.5
5,217,813 A 6/1993 Roser et al.
5,952,104 A * 9/1999 Sugiyama et al. ..... 428/32.34
6,131,514 A 10/2000 Simons
6,277,498 B1 * 8/2001 Endo et al. ..... 428/500
6,393,980 B2 * 5/2002 Simons ..... 101/128.21
2002/0051931 A1 5/2002 Mori et al.

FOREIGN PATENT DOCUMENTS

EP 0 601 204 A1 6/1994
EP 0 882 584 A1 12/1998
EP 1 157 825 A1 11/2001
JP 53-15905 2/1978

OTHER PUBLICATIONS

JP Abstract 56–105960.

* cited by examiner

*Primary Examiner*—Andrew H. Hirshfeld
*Assistant Examiner*—Jill E. Culler

(57) ABSTRACT

The invention relates to a method for the preparation of a printing plate comprises forming an oleophilic image on a substrate for a printing plate comprising a support having at least one hydrophilic layer on its surface, the oleophilic image being formed by inkjet printing an aqueous solution or aqueous colloidal dispersion of an anionic oleophilising agent on the surface of the support and drying the applied solution or dispersion, such that, on drying, the area of the surface to which the solution or dispersion was applied becomes lithographic ink-accepting, characterised in that the hydrophilic layer comprises a crosslinked cationic polymer.

The invention further relates to a substrate for a printing plate comprising a support having at least one hydrophilic layer on its surface wherein the hydrophilic layer comprises a crosslinked cationic polymer.

13 Claims, No Drawings

METHOD AND SUBSTRATE FOR THE PREPARATION OF A PRINTING PLATE

CROSS REFERENCE TO RELATED APPLICATIONS

Reference is made to commonly-assigned and copending U.S. patent application Ser. No. 10/628,853, entitled METHOD FOR THE PREPARATION OF A PRINTING PLATE by Michael J. Simons et al., and Ser. No. 10/628,639, entitled METHOD AND COMPOSITION FOR THE PREPARATION OF A PRINTING PLATE, by Michael J. Simons et al., both filed herewith, the disclosure(s) of which are incorporated herein.

FIELD OF THE INVENTION

This invention relates to a method and substrate for the preparation of a printing plate suitable for lithographic printing.

BACKGROUND OF THE INVENTION

Printing plates suitable for offset lithographic printing are known which comprise a support having non-image areas which are hydrophilic and image areas which are hydrophobic and ink-receptive.

The art of lithographic printing is based upon the immiscibility of oil and water, wherein the oily material or ink is preferentially retained by the image area and water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper or cloth.

Commonly the ink is transferred to an intermediate material called the blanket, which in turn transfers the ink to the surface of the material upon which the image is to be reproduced.

Inkjetting is the non-impact method for producing images by the deposition of ink droplets on a substrate in response to digital signals.

JP-A-53015905 describes the preparation of a printing plate by inkjetting an alcohol-soluble resin in an organic solvent onto an aluminium printing plate.

JP-A-56105960 describes the formation of a printing plate by inkjetting onto a support, e.g. an anodised aluminium plate, an ink capable of forming an oleophilic image and containing a hardening substance such as epoxy-soybean oil, together with benzoyl peroxide or a photo-hardening substance such as an unsaturated polyester.

EP-A-0 882 584 describes a method of preparing a printing plate comprising producing an oleophilic image on the surface of a support by inkjet printing the image on the surface using an aqueous solution of a salt of a hydrophobic organic acid, e.g. oleic acid.

U.S. Pat. No. 6,131,514 describes a method of preparing a printing plate comprising producing an oleophilic image on the surface of a support by inkjet printing the image on the surface using an aqueous solution or aqueous colloidal dispersion of a polymer bearing water-solubilising groups, wherein the water-solubilising groups interact with the surface of the support thereby binding the polymer to the support and rendering the polymer insoluble.

PROBLEM TO BE SOLVED

Inkjet printing provides a rapid and simple way of preparing a printing plate directly from digital information on a computer, which uses simpler and much less expensive equipment than commonly used computer-to-plate systems, which use high power lasers in the case of thermal effect platesetters, or lower power lasers together with a wet processing step in the case of visible light platesetters.

It is preferred that the inkjet writing fluids are water-based for environmental and health reasons, and also to avoid the excessive evaporation and drying-out at the jets which can occur with moderately volatile organic solvents.

However, known methods of preparing lithographic printing plates by applying aqueous solutions of oleophilising agent by inkjet only give good results when grained anodised aluminium is used as the printing plate substrate, and for some applications it is desired to use a substrate such as polyester film or a paper substrate which is less expensive, lighter in weight, and easier to transport through an inkjet printer than aluminium. The present invention enables this.

It is also found that some oleophilising agents, when used with grained anodised aluminium as the printing plate substrate, show improved performance on the press when the aluminium substrate is coated with a hydrophilic layer according to the invention.

SUMMARY OF THE INVENTION

The invention provides a method for the preparation of a printing plate comprising forming an oleophilic image on a substrate for a printing plate comprising a support having at least one hydrophilic layer on its surface, the oleophilic image being formed by inkjet printing an aqueous solution or aqueous colloidal dispersion of an anionic oleophilising agent on the surface of the support and drying the applied solution or dispersion, such that, on drying, the area of the surface to which the solution or dispersion was applied becomes lithographic ink-accepting, characterised in that the hydrophilic layer comprises a crosslinked cationic polymer.

The invention also provides a substrate for a printing plate comprising a support having at least one hydrophilic layer on its surface wherein the hydrophilic layer comprises a crosslinked cationic polymer.

DETAILED DESCRIPTION OF THE INVENTION

The support for the substrate of the invention may be any material having suitable thickness and mechanical properties for use as a printing plate on a lithographic printing press. Suitable supports include metallic, polymeric and paper-based supports, e.g. sheets or foils. Specific examples of supports include sheet aluminium, which may be grained and anodised, polyester film and supports which comprise fibrous material bound together with suitable resin or polymer.

The support is coated with a layer comprising a cationic polymer, that is a polymer that bears positively charged groups attached to the polymer chain. Preferably the polymer bears primary, secondary, tertiary or quaternary amino groups.

Examples of suitable cationic polymers include polyalkylene-polyamines and alkylated derivatives thereof, products of addition of alkylcarboxylic acids and polyalkylenepolyamines, products of addition of ketones and polyalkylenepolyamines, products of addition of aldehydes and polyalkylenepolyamines, products of addition of isocyanates and polyalkylenepolyamines, products of addition of isothiocyanates and polyalkylenepolyamines, products of addition of alkylene oxides and polyalkylenepolyamines and products of addition of polyalkylene oxide block copolymers and polyalkylenepolyamines.

A particularly preferred polymer is polyethyleneimine.

The polymer may be applied to the support as an aqueous solution, and the pH of the solution may be adjusted to a value from pH 3 to pH 10, preferably from pH 5 to pH 9.

The cationic polymer may be present in an amount from 0.01 to 10 g/m$^2$, preferably from 0.05 to 1.0 g/m$^2$.

Other compatible polymers, such as polyvinyl alcohol or polyvinylpyrrolidone, may be present in addition to the cationic polymer.

The coated layer is crosslinked with a suitable crosslinking agent to render it insoluble in water and of sufficient mechanical strength.

Examples of crosslinking agents which react with amino groups include formaldehyde, dialdehydes such as gluteraldehyde and succinaldehyde, epoxy compounds and activated vinyl compounds such as bis (vinyl sulfonyl) methane and bis (vinyl sulfonyl methyl) ether.

Further examples of crosslinking agents are described in Chapter 2 of "The Theory of the Photographic Process", Fourth Edition, edited by T. H. James and published by the Eastman Kodak Company, 1977.

The amount of crosslinking agent employed may be from 1 to 100 w/w %, preferably from 3 to 30 w/w %, based on the weight of the cationic polymer.

Inorganic particulate materials, such as silica, alumina, titanium dioxide or kaolin may be incorporated in the coated hydrophilic layer. The inorganic particulate material may be present in an amount from 0.1 to 30 g/m$^2$, preferably from 0.5 to 10 g/m$^2$.

Additional layers may be coated above or below the cationic polymer layer, including adhesion-promoting layers such as gelatin between the cationic polymer layer and the support. Preferably, the cationic polymer layer is the outermost layer.

The writing fluid comprises an aqueous solution or colloidal dispersion of an anionic oleophilising agent. In one aspect of the invention, the aqueous solution or colloidal dispersion of the anionic oleophilising agent does not comprise pigment particles dispersed therein.

Preferably, the anionic oleophilising agent is a hydrophobic organic acid or a salt thereof. The hydrophobic organic acid may be selected from hydrophobic organic carboxylates, sulfonates, sulfates, phosphonates and phosphates. Examples of suitable hydrophobic organic acids or salts thereof include fatty acids and their salts. The hydrophobic organic acid or salt thereof may be an anionic surfactant.

Examples of monobasic carboxylic and sulfonic acids with hydrophobic groups which function as oleophilising agents are given in EP-A-0 882 584 and include oleic acid, stearic acid and surfactants such as AEROSOL™ TR70.

Examples of monobasic phosphoric and phosphonic acids with hydrophobic groups which function as oleophilising agents are given in EP-A-1 157 825.

Examples of dibasic carboxylic acids and dibasic sulfonic-carboxylic acids with hydrophobic groups which function as oleophilising agents are given in commonly-assigned and copending U.S. patent application Ser. No. 10/628,853, entitled METHOD FOR THE PREPARATION OF A PRINTING PLATE by Michael J. Simons et al., filed herewith.

The hydrophobic organic acid may be polymeric.

Examples of polymeric substances bearing a multiplicity of acid groups and which function as oleophilising agents are given in U.S. Pat. No. 6,131,514, and in WO 00/37254 and 00/37261.

The acid groups of the oleophilising agents are preferably at least partly neutralised in the form of salts, such as salts of a metal ion such as sodium, potassium and lithium, or ammonium salts including salts of quaternary ammonium compounds or salts of other cations such as pyridinium.

The anionic oleophilising agent may be present in the aqueous solution or aqueous colloidal dispersion in an amount from 0.02 to 5% by weight, preferably from 0.05 to 1% by weight.

It is necessary that the polymer is in the form of an aqueous solution or a stable colloidal dispersion so that it can pass through the jets of the printer head.

While water is the preferred aqueous carrier medium, the aqueous composition may comprise one or more water-miscible solvents, e.g. a polyhydric alcohol such as ethylene glycol, diethylene glycol, triethylene glycol or trimethylol propane. The amount of aqueous carrier medium in the aqueous composition may be in the range from 30 to 99.995, preferably from 50 to 95% by weight.

Jet velocity, separation length of the droplets, drop size and stream stability are greatly affected by the surface tension and the viscosity of the aqueous composition. Inkjet inks suitable for use with inkjet printing systems may have a surface tension in the range from 20 to 60, preferably from 30 to 50 dynes/cm. Control of surface tensions in aqueous inks may be accomplished by the addition of a small amount of surfactant(s). The level of surfactant to be used can be determined through simple trial-and-error experiments. Anionic and nonionic surfactants may be selected from those disclosed in U.S. Pat. Nos. 5,324,349; 4,156,616 and 5,279,654, as well as many other surfactants known in the inkjet art. Commercial surfactants include the SURFYNOL™ range from Air Products; the ZONYL™ range from DuPont; the FLUORAD™ range from 3M and the AEROSOL™ range from Cyanamid.

The viscosity of the ink is preferably no greater than 20 centipoise, e.g. from 1 to 10, preferably from 1 to 5 centipoise at room temperature.

The solution used in the ink jet printer may comprise other ingredients, for instance water-soluble liquids or solids with a substantially higher boiling point than water, e.g. ethanediol. A humectant or co-solvent may be included to help prevent the ink from drying out or crusting in the orifices of the print head. A biocide, such as PROXEL™ GXL from Zeneca Colours may be added to prevent unwanted microbial growth which may occur in the ink over time. Additional additives which may optionally be present in the ink include thickeners, pH adjusters, buffers, conductivity-enhancing agents, anti-kogation agents, drying agents and defoamers.

The aqueous composition is employed in inkjet printing wherein drops of the composition are applied in a controlled fashion to the surface of the support by ejecting droplets from a plurality of nozzles or orifices in a print head of an inkjet printer.

Commercially available inkjet printers use several different schemes to control the deposition of the ink droplets. Such schemes are generally of two types: continuous stream and drop-on-demand.

In drop-on-demand systems, a droplet of ink is ejected from an orifice directly to a position on the ink receptive layer by pressure created by, for example, a piezoelectric device, an acoustic device or a thermal process controlled in accordance with digital signals. An ink droplet is not generated and ejected through the orifices of the print head unless it is needed. Inkjet printing methods and related printers are commercially available and need not be described in detail.

The aqueous composition may have properties compatible with a wide range of ejecting conditions, e.g. driving voltages and pulse widths for thermal inkjet printers, driving frequencies of the piezoelectric element for either a drop-on-demand device or a continuous device, and the shape and size of the nozzle. After writing the image to the printing plate, the printing plate may be inked with printing ink in the normal way and the plate used on a printing press. Before inking, the plate may be treated with an aqueous solution of natural gum, such as gum acacia, or of a synthetic gum, such as carboxymethyl cellulose, as is well known in the art of printing, see for example Chapter 10 of "The Lithographer's Manual", edited by Charles Shapiro and published by The Graphic Arts Technical Foundation, Inc., Pittsburgh, Pa. (1966).

The invention is further illustrated by way of specific example as follows. Unless otherwise indicated, all percentages are by weight.

EXAMPLE 1

A lithographic substrate according to the invention was prepared by coating polyethylene terephthalate photographic film base from aqueous solution with the following coverages of the stated substances:

| | |
|---|---|
| Cationic colloidal silica LUDOX CL ™ | 5.0 g/m$^2$ |
| Polyethyleneimine (used as a 5% w/w solution and adjusted to pH 6.5 with sulfuric acid) | 0.8 g/m$^2$ |
| bis(vinylsulfonyl)methane (hardener) | 0.05 g/m$^2$ |

An inkjet writing fluid was prepared as follows:

To 11.5 ml water was added 2.5 ml 4% w/w aqueous solution of AEROSOL™ 22, 2 ml ethanediol and 4 ml 2% w/w aqueous solution of the dye Phloxine B. (The AEROSOL™ 22 was the oleophilising compound, ethanediol a humectant and the dye was present to make the fluid visible on the plate).

The black cartridge of a Lexmark Z43 inkjet printer was emptied, the plastic foam removed and residual ink washed out. It was refilled with the above writing fluid and a wad of cotton wool in place of the foam. The cartridge was replaced in the printer and a test pattern was printed onto a sheet of the film as described above.

A second test pattern was printed on a sheet of grained and anodised aluminium printing plate substrate, which served as a comparative substrate of the prior art.

When the test pattern had dried, the resulting printing plates were mounted on the plate cylinder of a Heidelberg T-Offset printing press, the press rollers were inked up using fount solution (Varn International™ Universal Pink Fount Solution, diluted 1+15 with water) and K&E™ Novaquick 123W oil-based black ink and printing started. Clean prints were obtained from the first impression. The quality of the printed impressions of the test pattern was monitored as the print runs continued.

After 500 impressions, it was seen that the prints from the aluminium plate were losing fine detail and the printing run with that plate was stopped. The prints from the coated film substrate of the invention remained of high quality and were still of high quality after 2500 impressions, demonstrating the superior press performance of the invention.

EXAMPLE 2

This example illustrates a substrate of the invention used with writing fluids comprising a variety of oleophilising compounds.

Solutions of the oleophilising compounds were prepared by dissolving them in water at a concentration of 0.5% w/w. If the oleophilising compound was in the form of a free acid, sufficient sodium hydroxide solution was added to convert all the acid to the sodium salt. Each solution was applied to a portion of a hydrophilic substrate with a small squirrel-hair paintbrush and allowed to dry.

The hydrophilic substrate was a polyethylene terephthalate photographic film base coated from aqueous solution with the following coverages of the stated substances:

| | |
|---|---|
| Cationic colloidal silica LUDOX CL ™ | 3.0 g/m$^2$ |
| Polyethyleneimine (used as a 5% w/w solution and adjusted to pH 6.5 with sulfuric acid) | 0.6 g/m$^2$ |
| bis(vinylsulfonyl)methane (hardener) | 0.05 g/m$^2$ |

Portions of the hydrophilic substrate were gently wiped with a piece of cotton wool, which was wetted with water. A little black lithographic printing ink was then applied to the cotton wool and the inked cotton wool pad rubbed gently over the substrate. The test was then repeated, except that the cotton wool was wetted with lithographic press fount solution (Varn International™ Universal Pink Fount Solution, diluted 1+15 with water).

This test was carried out with the following compounds according to the invention: AEROSOL™ 22, AEROSOL™ 18, EMCOL™ K8300, and compounds 2, 3, 4, 5, 7, 14, 16, and 18.

AEROSOL™ 22 has the structure

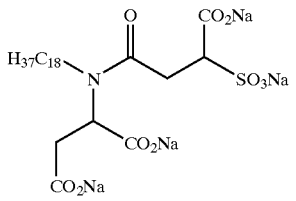

AEROSOL™ 18 has the structure

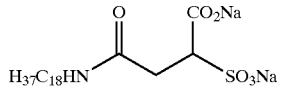

EMCOL™ 8300, has the structure

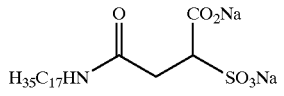

Compounds 2 to 5, 7, 14, 16 and 18 have the structures:

Compound 2

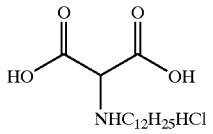

Compound 3

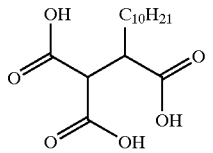

Compound 4

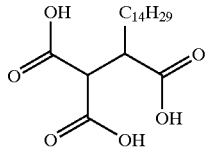

Compound 5

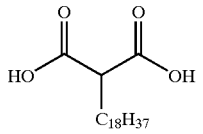

Compound 7

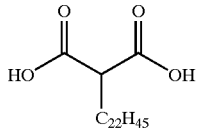

Compound 14

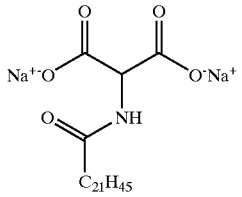

Compound 16

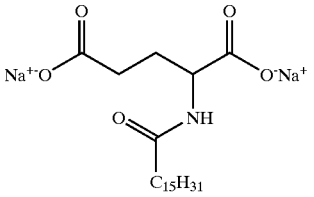

Compound 18

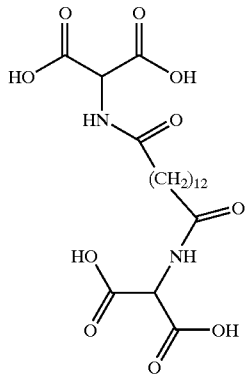

In the case wherein the cotton wool was wetted with water and also in the case wherein the cotton wool was wetted with fount solution, in the area of the substrate to which the solution of each oleophilising compound had been applied a clear black mark of adhering lithographic ink was observed, while the background areas of the substrate remained unmarked and wetted with water or fount solution. This demonstrated that the compounds showed an oleophilising effect on the substrates used, and so were potentially useful for making lithographic printing plates by inkjet application.

The test was also carried out with the following additional oleophilising compounds:

Sodium dodecyl sulfate,
Sodium benzene dodecyl sulfate,
Tri-isopropyl naphthalene sulfonate,
Dioctyl sulfosuccinate, sodium salt,
Sodium stearate, and

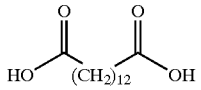

For all the additional compounds, when the test was done using water as the wetting liquid, in the area of the substrate to which the solution of the compound had been applied a clear black mark of adhering lithographic ink was observed, while the background areas of the substrate remained unmarked and wetted with water.

EXAMPLE 3

This example illustrates a substrate of the invention used with writing fluids comprising a variety of oleophilising compounds.

The test described in Example 2 was carried out using a number of oleophilising compounds using a hydrophilic substrate which consisted of polyethylene terephthalate photographic film base, coated from aqueous solution with the following coverages of the stated substances:

| | |
|---|---|
| Cationic colloidal silica LUDOX CL ™ | 4.0 g/m$^2$ |
| Polyethyleneimine (used as a 5% w/w solution and adjusted to pH 6.5 with sulfuric acid) | 0.4 g/m$^2$ |
| bis(vinylsulfonyl)methane (hardener) | 0.033 g/m$^2$ |

In addition to the oleophilising compounds used in Example 2, the following compounds were used:

Compound 9

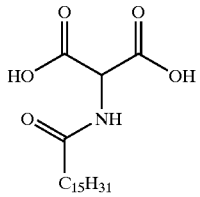

Compound 11

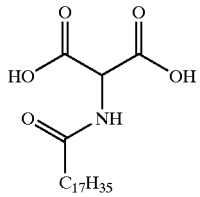

-continued

Compound 12

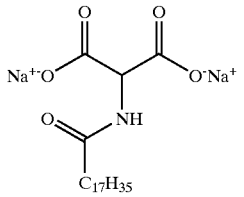

The resulting mark of adsorbed lithographic printing ink was then subjected to a wet abrasion test to estimate its robustness. A swab of soft cotton fabric was attached to a weight and moved to-and-fro over the surface, and the number of abrasion strokes required to remove the centre of the mark of adsorbed lithographic printing ink was recorded. The results were as follows:

| Compound | Number of strokes |
|---|---|
| 2 | 10 |
| 3 | 2 |
| 4 | 2 |
| 5 | 2 |
| 7 | 2 |
| 9 | 28 |
| 11 | 42 |
| 12 | 37 |
| 14 | 50 |
| 16 | 59 |
| 18 | 84 |

Compounds 2, 9, 11, 12, 14, 16 and 18 were examples of preferred compounds in which the linking group bound to the hydrophobic group is bonded to the carbon atoms between the acid groups via a nitrogen atom, and all showed better abrasion resistance than the substances which did not have that structure.

EXAMPLE 4

An inkjet writing fluid was prepared as follows:

To 11.5 ml water was added 2.5 ml 4% w/w aqueous solution of AEROSOL™ 22, 2 ml ethanediol and 4 ml 2% w/w aqueous solution of the dye Phloxine B. (The AEROSOL™ 22 was the oleophilising compound, ethanediol a humectant and the dye was present to make the fluid visible on the plate).

The black cartridge of a Lexmark Z43 inkjet printer was emptied, the plastic foam removed and residual ink washed out. It was refilled with the above writing fluid and a wad of cotton wool in place of the foam. The cartridge was replaced in the printer and a test pattern was printed onto a sheet of the hydrophilic substrate as described in Example 1.

When the test pattern had dried, the resulting polyester film printing plate was mounted on the plate cylinder of a Heidelberg T-Offset printing press, the press rollers were inked up using fount solution as described in Example 1 and K&E™ Novaquick 123W oil-based black ink and printing started. Clean prints were obtained from the first impression and 2000 copies of the test pattern were printed without noticeable deterioration.

EXAMPLE 5

This example illustrates the substrate of the invention used with a writing fluid which comprises a negatively charged polymer (the anionic polymer AQ55S, a sulfonated polyester, supplied by Eastman Chemical Corporation) in the presence of finely dispersed pigments.

Yellow Pigment Dispersion:

The yellow pigment used in the writing fluid of the present invention was prepared as follows: A mixture was prepared containing the following components: 8000 g polymeric beads, mean diameter 50 μm (milling media); 1600 g Pigment Yellow 155 (Clariant Corp.); 400 g oleoyl methyl taurine, (OMT), potassium salt and 4880 g deionized water.

The above components were milled in a 40 l double-walled vessel obtained from BYK-Gardner, using a high energy media mill manufactured by Morehouse-Cowles Hochmeyer. The mill was run for approximately 8 h at room temperature. The dispersion was separated from the milling media by filtering the mill grind through a 4–8 μm KIMAX™ Buchner Funnel, obtained from VWR Scientific Products. An additional 8000 g dilution water was added to the filtered dispersion followed by a biocide, PROXEL™ GXL (Zeneca Corp.). The pigment is about 9.91% by weight of the total final dispersion and the biocide is about 230 ppm by weight of the total final dispersion. The median pigment particle size is about 38 nm, as measured by MICROTRAC II Ultrafine particle analyzer (UPA) manufactured by Leeds & Northrup.

Cyan Pigment Dispersion:

The cyan pigment dispersion was prepared similarly to the yellow pigment dispersion except that Pigment Blue 15:3 (Clariant Corp.) was used instead of Pigment Yellow 155. The amount of OMT potassium salt was 25 wt % based on the pigment. The pigment was about 9.97% by weight of the total final dispersion. The median pigment particle size was about 32 nm as measured by MICROTRAC™ II Ultrafine particle analyzer (UPA) manufactured by Leeds & Northrup.

Yellow Writing Fluid:

To prepare the yellow writing fluid, 24.97 g yellow pigment dispersion described above (9.91% active), 0.2 g SURFYNOL™ 465 (Air Products Inc.), 8.40 g glycerol, 14.5 g triethylene glycol and 3.00 g di(propylene-glycol) methyl ether (DOWANOL™ DPM) and 9.52 g of AQ55™ (10.5% active) were added together with distilled water so that the final weight of the ink was 100.0 g. The final ink contained 2.48% Pigment Yellow 155, 0.50% SURFYNOL™ 465, 8.40% glycerol, 14.5% triethylene glycol, 3% di(propylene-glycol) methyl ether and 1% AQ55™. The solution was filtered through a 3 μm polytetrafluoroethylene filter.

Cyan Writing Fluid:

To prepare the cyan writing fluid, 16.55 g of cyan pigment dispersion described above (9.97% active), 0.2 g SURFYNOL™ 465 (Air Products Inc.), 6.50 g glycerol, 18.7 g triethylene glycol and 3.50 g di(propyleneglycol) methyl ether (DOWANOL™ DPM) and 9.52 g of AQ55™ (10.5% active) were added together with distilled water so that the final weight of the ink was 100.0 g. The final ink contained 1.65% Pigment Blue 15:3, 0.50% SURFYNOL™ 465, 6.50% glycerol, 18.70% triethylene glycol, 3.50% di(propyleneglycol) methyl ether and 1.0% AQ55™. The solution was filtered through a 3 μm polytetrafluoroethylene filter.

The black cartridge of a Lexmark Z43 inkjet printer was emptied, the plastic foam removed and residual ink washed out. It was refilled in turn with each of the above writing fluids with a wad of cotton wool in place of the foam. The cartridge was replaced in the printer and a test pattern was printed onto a sheet of hydrophilic substrate, which comprised polyethylene terephthalate photographic film base coated from aqueous solution with the following coverages of the stated substances:

| | |
|---|---|
| Cationic colloidal silica LUDOX CL ™ | 4.0 g/m$^2$ |
| Polyethyleneimine (used as a 5% w/w solution and adjusted to pH 6.5 with sulfuric acid) | 0.4 g/m$^2$ |
| bis(vinylsulfonyl)methane (hardener) | 0.024 g/m$^2$ |

The resulting imaged printing plates were mounted on a printing press and printed as described in Example 1. Good sharp prints having excellent resolution were obtained for plates made with each of the writing fluids and 4500 impressions were run without any loss or fading of the test pattern.

The invention has been described in detail with particular reference to certain preferred embodiments thereof, but it will be understood that variations and modifications can be effected within the spirit and scope of the invention.

What is claimed is:

1. A method for the preparation of a printing plate comprising forming an oleophilic image on a substrate for a printing plate comprising a support having at least one hydrophilic layer on its surface, the oleophilic image being formed by inkjet printing an aqueous solution or aqueous colloidal dispersion of an anionic oleophilising agent on the surface of the support and drying the applied solution or dispersion, such that on drying the area of the surface to which the solution or dispersion was applied becomes lithographic ink-accepting, characterised in that the hydrophilic layer comprises a crosslinked cationic polymer.

2. A method as claimed in claim 1 wherein the substrate is a metallic, polymeric or paper-based support coated with a layer comprising a crosslinked cationic polymer.

3. A method as claimed in claim 1 wherein the cationic polymer comprises amino groups selected from primary, secondary, tertiary and quaternary amino groups.

4. A method as claimed in claim 1 wherein the cationic polymer is selected from the group consisting of polyalkylenepolyamines and alkylated derivatives thereof, products of addition of alkylcarboxylic acids and polyalkylenepolyamines, products of addition of ketones and polyalkylenepolyamines, products of addition of aldehydes and polyalkylenepolyamines, products of addition of isocyanates and polyalkylenepolyamines, products of addition of isothiocyanates and polyalkylenepolyamines, products of addition of alkylene oxides and polyalkylenepolyamines and products of addition of polyalkylene oxide block copolymers and polyalkylenepolyamines.

5. A method as claimed in claim 1 wherein the cationic polymer is polyethyleneimine.

6. A method as claimed in claim 1 wherein the cationic polymer is present in an amount from 0.01 to 10 g/m$^2$.

7. A method as claimed in claim 1 wherein the layer comprising a cationic polymer further comprises inorganic particulate material.

8. A method as claimed in claim 7 wherein the inorganic particulate material is selected from the group consisting of particulate silica, alumina, titanium dioxide and kaolin.

9. A method as claimed in claim 7 wherein the inorganic particulate material is present in an amount from 0.1 to 30 g/m$^2$.

10. A method as claimed in claim 1 wherein the anionic oleophilising agent is selected from the group consisting of hydrophobic organic acids and salts thereof.

11. A method as claimed in claim 10 wherein the hydrophobic organic acid is selected from hydrophobic organic carboxylates, sulfonates, sulfates, phosphonates and phosphates.

12. A method as claimed in claim 10 wherein the hydrophobic organic acid is polymeric.

13. A method as claimed in claim 1 wherein the anionic oleophilising agent is present in the aqueous solution or aqueous colloidal dispersion in an amount from 0.02 to 5% by weight.

* * * * *